United States Patent [19]

Baumgart

[11] Patent Number: 4,793,103

[45] Date of Patent: Dec. 27, 1988

[54] CONTINUOUS DEFLASHING APPARATUS FOR MOLDED ARTICLES

[75] Inventor: Jurgen Baumgart, Huntingdon Beach, Calif.

[73] Assignee: ACD, Inc., Santa Ana, Calif.

[21] Appl. No.: 897,850

[22] Filed: Aug. 19, 1986

[51] Int. Cl.[4] ..... B24C 03/14B24C9/00

[52] U.S. Cl. ..... 51/418; 51/322; 51/426

[58] Field of Search ..... 51/319, 320, 321, 322, 51/410, 417, 418, 419, 420, 421, 422, 423, 425, 426; 198/713, 714, 802, 803.14; 62/63, 65; 241/23, 65

[56] References Cited

U.S. PATENT DOCUMENTS

| | | | |
|---|---|---|---|
| 2,254,420 | 9/1941 | Cleveland | 198/713 X |
| 2,621,446 | 12/1952 | Russell | 51/426 X |
| 3,507,128 | 4/1970 | Murphy et al. | 62/63 |
| 3,769,754 | 11/1973 | Ixer et al. | 51/418 X |
| 4,072,026 | 2/1978 | Oberpriller et al. | 62/63 |
| 4,270,317 | 6/1981 | Kurie | 51/426 |
| 4,317,665 | 3/1982 | Prentice | 62/63 |
| 4,355,488 | 10/1982 | Schmitz et al. | 51/319 |
| 4,492,102 | 1/1985 | Lienert | 51/420 X |

*Primary Examiner*—Robert P. Olszewski
*Attorney, Agent, or Firm*—Jackson & Jones

[57] ABSTRACT

A cryogenic deflashing apparatus includes a plurality of serially oriented work stations and a conveyor for transporting articles to be deflashed past each of the stations. The work stations include (1) a prechill station connected to vapor compression refrigeration system to lower the temperature below ambient (2) a chill station connected to a cryogenic refrigeration system in which a cryogenic refrigerant such as liquid nitrogen is introduced into a closed coil adjacent the station for cooling the residual flash on the article to the embrittlement point while maintaining an atmosphere of air at the station and delivering the vaporized cryogen for use in other processes and (3) a deflashing station in which a blasting media such as plastic pellets are propelled against the article to remove the flash. An article carrying open mesh basket is also provided on the conveyor for orienting the article in a preselected attitude with respect to the blasting media pattern.

12 Claims, 4 Drawing Sheets

CONTINUOUS DEFLASHING APPARATUS FOR MOLDED ARTICLES

BACKGROUND OF THE INVENTION

1. Field of the Invention

The present invention relates to deflashing apparatus and more particularly to cryogenic deflashing apparatus for removing flash and burrs from molded articles or parts in a low temperature environment by bombarding the articles with a high velocity media stream.

2. Description of the Prior Art

The molding of articles from plastic, rubber and other materials generally leaves a residual flash on the article in the area adjacent the interfacing mold surfaces. Such flash is functionally and aesthetically objectionable. The removal of such flash by hand trimming is costly and sometimes difficult.

To eliminate the hand trimming operation deflashing apparatus has been developed which cools the flash to the embrittlement point and then subjects the articles to a high velocity stream of pellets, commonly referred to as the blasting or deflashing media. To cool the flash to the embrittlement point the prior art apparatus injects cryogenic liquids, such as liquid nitrogen directly into a chamber in which the deflashing media is propelled against the articles or through which the articles are conveyed on their way to a deflashing area or station. See U.S. Pat. Nos. 4,355,488 and 4,030,247. The cryogenic liquid vaporizes by exchanging heat with the articles, atmosphere and surrounding structures. Since the energy required to produce liquid cryogens is substantial the use of such prior art apparatus is expensive.

In addition cryogens used in the prior art apparatus displace the ambient air and create an asphyxiating atmosphere within and surrounding the deflashing chamber. As a result of the substantial safety hazzards posed by the cryogenic environment some of the prior art apparatus have incorporated expensive systems such as automatically operated doors for permitting articles to be inserted and removed from the deflashing area (see the '488 patent noted above) to minimize the leakage of cryogen into the surrounding atmosphere. While such doors may reduce the safety hazzard for the area surrounding the deflashing chamber, they do not reduce the hazzard posed to personnel required to gain entrance to the chamber for maintenance purposes.

The prior art apparatus also has certain deficiencies with respect to the effecient and thorough removal of flash. Many molded articles have flash on only one side. The prior art apparatus has typically employed conveyor systems which indescriminately present either side of an article to the media blast pattern depending upon how the article was placed on the conveyor. Other prior art conveyor systems have been arranged to tumble or rotate the article or parts as they are carried through the deflashing chamber. In the first case inconsistent and unsatisfactory deflashing may result. In the second case the time required to remove the flash may be unduly high for articles with flash located primarily or solely on one side. Such an increased exposure time increases the overall production time and cost. In addition the increased exposure of the main body of the article to the low temperature environment and deflashing media increases the possibility of damage to the article.

The above deficiencies of the prior art apparatus are overcome by the present invention.

SUMMARY OF THE INVENTION

In accordance with the present invention an apparatus for removing residual flash from molded articles is provided which includes a housing defining a plurality of individual work stations or chambers. The work stations include a prechill station, a chill station and a deflashing station arranged in that order. A vapor compression (or mechanical) refrigeration system is connected to the prechill station to maintain the temperature at the prechill station between ambient temperature and that necessary to embrittle the residual flash.

A cryogenic refrigeration system is connected to the chill station to cool the molded articles until the residual flash is embrittled. The cryogenic system includes (1) a closed coil disposed within the housing, (2) means for introducing low temperature cryogen (such as liquid nitrogen) into the coil, (3) means for circulating air past the coil and the molded articles located at the chill station to embrittle the flash and (4) means for removing the vaporized cryogen from the coil after it has accepted heat from the circulating air.

The deflashing apparatus further includes means such as a single or a plurality of impellers for directing the deflashing media at high velocity in a selected pattern centered around a predetermined axis at articles located at the deflashing station.

A novel conveyor system is also provided in which a plurality of article carrying means, such as open mesh baskets, are arranged to hold the molded articles in a preselected attitude with respect to the predetermined axis of the blast media to expose a preselected area of the articles to the deflashing media. The conveyor system ensures that the articles are properly oriented at the deflashing station to optimize the removal of the flash.

The features of the present invention which are novel are set forth with particularly in the appended claims. The invention, both as to its organization and operation, together with further objects and advantages thereof may best be understood by reference to the following description taken in conjunction with the accompanying drawings.

DESCRIPTION OF THE PREFERRED EMBODIMENT

Figure 1:
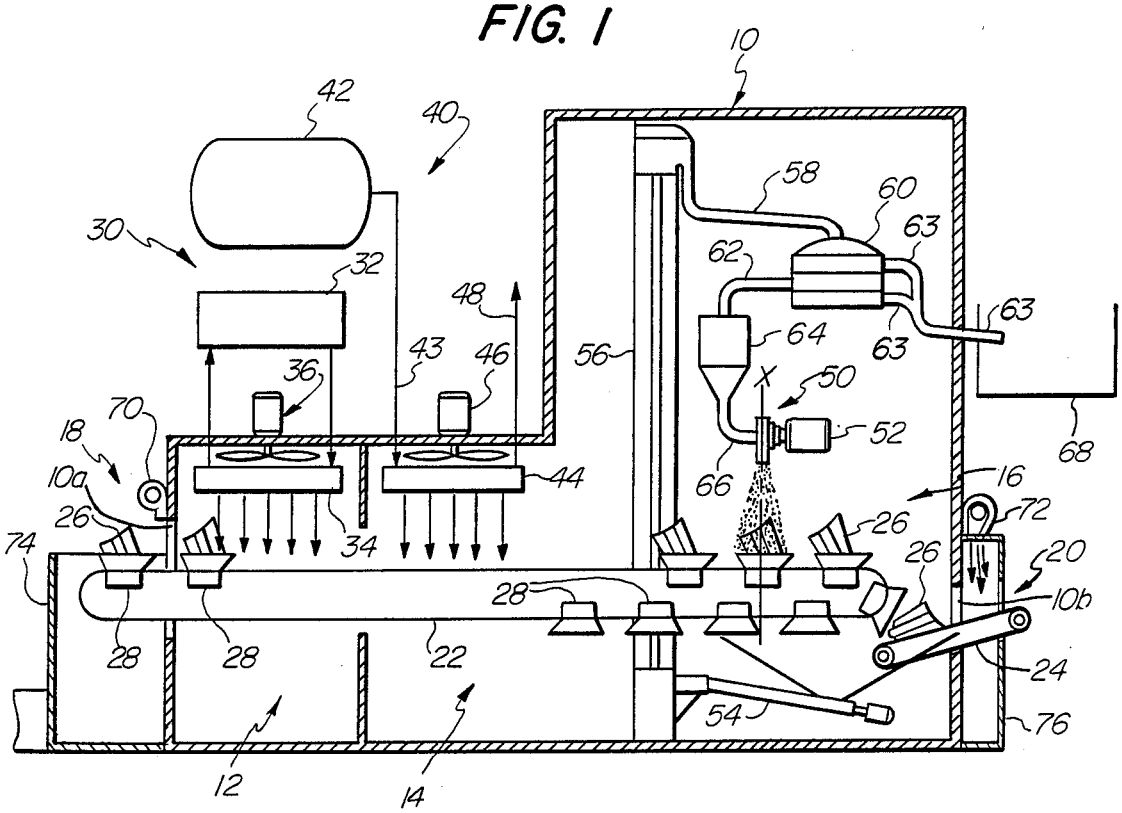
FIG. 1 is a side elevation view in cross section of a deflashing apparatus in accordance with this invention.

Referring now to the drawings and particularly to FIG. 1 an insulated housing 10 is separated into a plurality of work stations or chambers including a prechill station 12, a chill station 14 and a deflashing station 16, arranged in that order.

A loading station 18 is located outside of the housing adjacent the prechill station and an unloading station 20 is located outside of the housing adjacent the deflashing station 10. A pair of conveyors 22 and 24 transport molded articles 26 from the load station past each of the prechill, chill and deflashing stations and then to the unload station. The molded articles are carried in open mesh wire baskets 28 as illustrated. See FIG. 7.

The baskets 28 are spaced along the endless conveyor 22 and hold the molded articles (illustrated as automobile bumper facies) in a predetermined attitude with respect to the blast media pattern as will be explained. The molded articles fall by gravity from the baskets onto the exit conveyor 24 (which may be in the form of an endless belt) at the end of the conveyor 22 in the deflashing chamber 16 as illustrated.

The prechill station or chamber 12 is maintained at a suitable temperature between ambient and that required to embrittle the residual flash (not shown) on the molded articles 26 (e.g. 31 5020 F.) by a mechanical refrigeration system 30. The refrigeration system 30 is of the conventional vapor compression type in which a refrigerant such as freon vapor is compressed and cooled in a compressor/heat exchanger 32 to its liquid state. The liquid freon is then expanded for example, in a throttling valve (not shown in FIG. 1) and introduced into an evaporator or heat exchanger 34 located within the prechill chamber 12 of the housing 10. A blower or fan 36 circulates air through the heat exchanger 34 and past the molded articles 26 to lower the temperature of the articles and the residual flash thereon in preparation for the embrittlement step.

A cryogenic refrigeration system for providing a low temperature (e.g. −120° F.) at the chill station 14 sufficient to embrittle the residual flash on the articles is illustrated at 40. The cryogenic refrigeration system includes a reservoir 42 of liquid cryogen such as nitrogen and a vaporizer or heat exchanger 44 located within the chill chamber 14. Liquid nitrogen is introduced into the housing through an inlet conduit 43 and then vaporized within the closed coil of the heat exchanger 44. Air is circulated by a blower 46 through the vaporizer and past the articles to cause the flash to become embrittled. The spent nitrogen gas is conducted from the vaporizer 44 through the wall of the housing 10 by means of an outlet conduit 48. The nitrogen gas from the outlet conduit 48 may be used in other manufacturing or processing operations (not shown). The gas leaves the system with the same purity the cyrogenic liquid entered the system from the storage tank 42.

To remove the embrittled flash from the article body a single or a plurality of media throwing wheels or impellers 50 are located in the deflashing chamber 16 and arranged so that the blast media, which may be in the form of plastic pellets or the like, is propelled at high velocity in a selected pattern centered around a vertical axis x—x. The throwing wheel 50 (driven by motor 52) may be of conventional design (i.e. a straight vane centrifugal fan with the media introduced at the eye of the wheel). A shroud encloses the wheel and directs the media in the selected pattern. See for example U.S. Pat. No. 3,368,308.

The spent media is returned to the throwing wheel 50 by a screw conveyor 54, a vertical bucket elevator 56, a return conduit 58 a particle separator 60, a separator outlet pipe 62, a hopper 64 and a feed tube 66, all of conventional design. The residual flash removed from the articles by the blast media is delivered to a bin 68 from the separator 60 through conduits 63.

To reduce the egress of cold air from the housing 10 blowers 70 and 72 are disposed over the front and rear openings 10a and 10b in the housing, respectively, to provide a curtain of air between such openings and the surrounding outside area.

Guard frames 74 and 76 encloses portions of the conveyors 22 and 24 that extend outside of the housing 10 as illustrated to provide protection to operators loading and unloading the molded articles.

Figure 2:
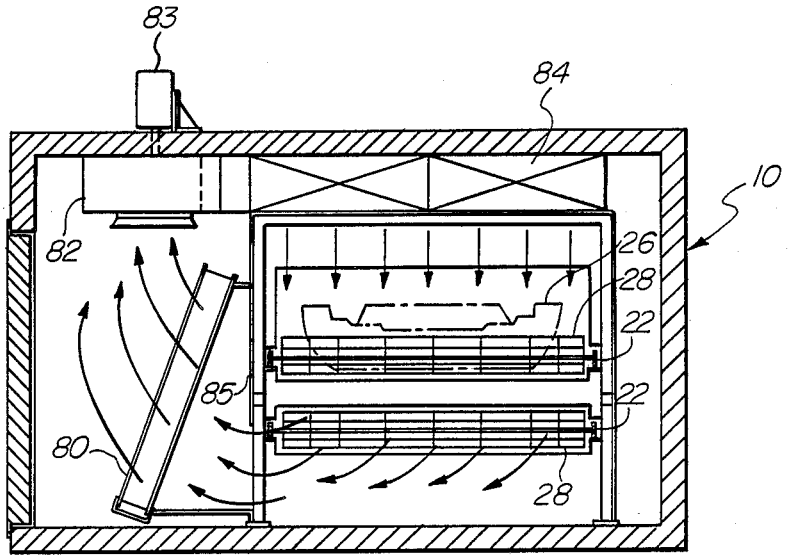
FIG. 2 is an end view of one of the prechill or chill chambers of the apparatus of FIG. 1 with the heat exchange coil located beside instead of above the work station.

FIG. 2 is an end view of one of the prechill and chill chambers showing an alternative heat exchanger and blower arrangement. In this embodiment the heat exchanger 80 through which vapor or cryogenic refrigerant may be circulated is placed in a partioned off area beside the conveyor 22. Air is circulated by a blower 82 (driven by a motor 84) through a plenum past the molded article 26 and back through the heat exchanger 80 to maintain the temperature within the chamber at the desired temperature. A partition 85 serves to channel the air flow from the plenum past the articles 26.

Figure 3:
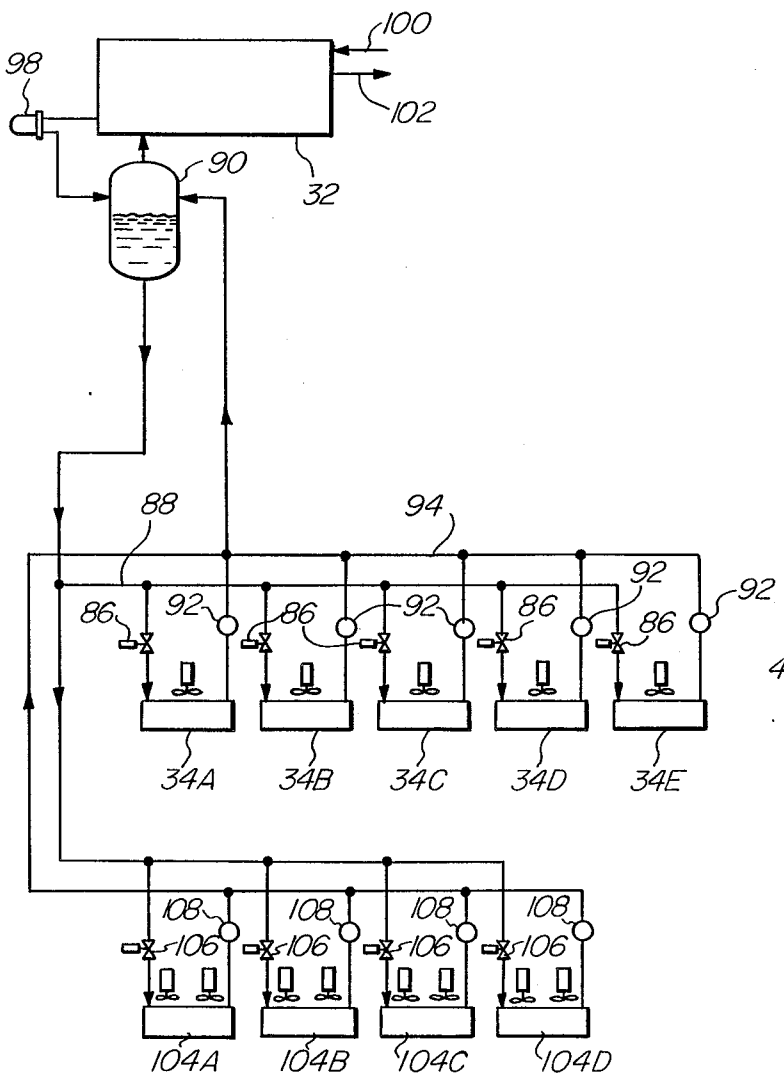
FIG. 3 is a schematic diagram of a vapor compression refrigeration system which may be employed in the apparatus of FIG. 1.

Referring now to FIG. 3 the vapor compression refrigeration system 30 is illustrated in more detail. The heat exchanger or evaporator 34 is separated into five units 34A, 34B, 34C, 34D and 34E which are spaced along the prechill chamber with four of the units normally operating in the cooling mode and one unit undergoing a defrosting cycle. Solenoid valves 86 are operated automatically (by means not shown) to introduce the cold refrigerant into the selected heat exchangers from a manifold 88 which is connected to a refrigerant flash tank 90. The refrigerant such as freon in the flash tank may be maintained at a suitable temperature such as −50° F. The refrigerant vapor generated in absorbing heat in the evaporators is returned to the tank 90 through check valves 92 and manifold 94. The vapor in the flash tank is compressed and cooled in the mechanical compressor/heat exchanger 32 and returned to the tank as a liquid through a condensor drain valve 98. Cooling water is supplied to the compressor/heat exchanger 32 via tubes 100 and 102.

Additional heat exchangers 104A, 104B, 104C and 104D may be located in the deflashing chamber if desired to maintain that chamber at a low temperature so that the embrittled flash will not warm during the time that the molded articles travel through the chamber. Refrigeration in this portion of the system also serves to control the humidity in the air and media. As illustrated the heat exchangers 104A are connected to the manifolds 88 and 94 through solenoid valves 106 and check valves 108.

Figure 4:
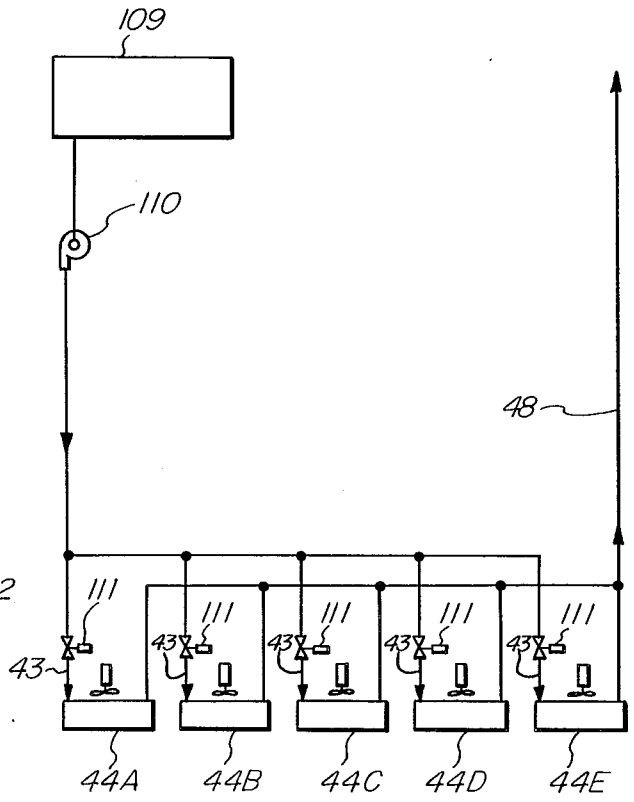
FIG. 4 is a schematic diagram of a cryogenic refrigeration system employed in the apparatus of FIG. 1.

The cryogenic refrigeration system is illustrated in FIG. 4 with the heat exchanger or vaporizer 44 separated into five units 44A spaced along the chill chamber 14. Like the vapor compressor system four of the heat vaporizers 44A–44E may be operating in the cooling mode and one in the defrosting mode. Liquid cryogen (e.g. $N_2$) is pumped from a storage tank 109 via a pump 110 to solenoid valves 111 supplied to the inlet 43 of each of the vaporizers 44A–44E. The vaporizer removes heat from the air being forced over it by blower 46, by converting the liquid cryogen to a gas and partially warming the gas. The vaporized cryogen gas from the outlet 48 of the heat exchangers is available for use with other manufacturing operations (not shown). It should be noted that where the pressure within the tank 109 is sufficient to deliver the liquid cryogen to the vaporizers 44A–44E, the pump 110 may be eliminated.

Figure 5:
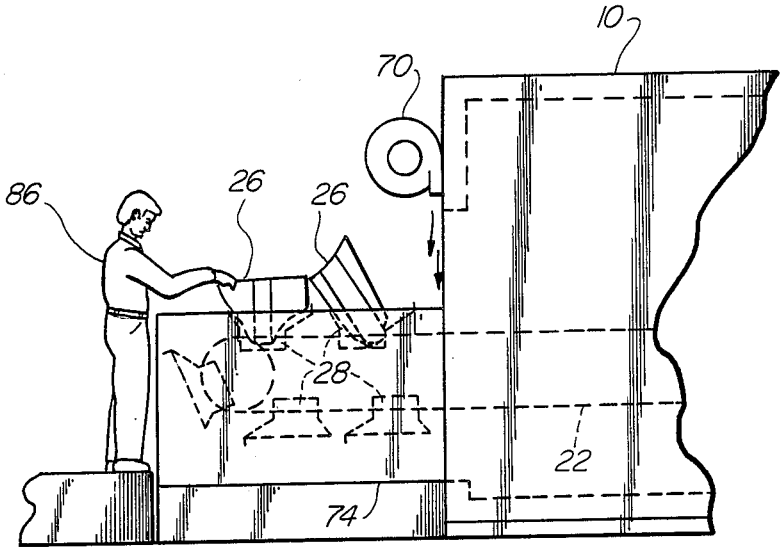
FIG. 5 is an enlarged side elevation view of the apparatus of FIG. 1 partially cut away to illustrate the loading station with a shield placed around the portion of the conveyor that extends outside of the main housing.
Figure 6:
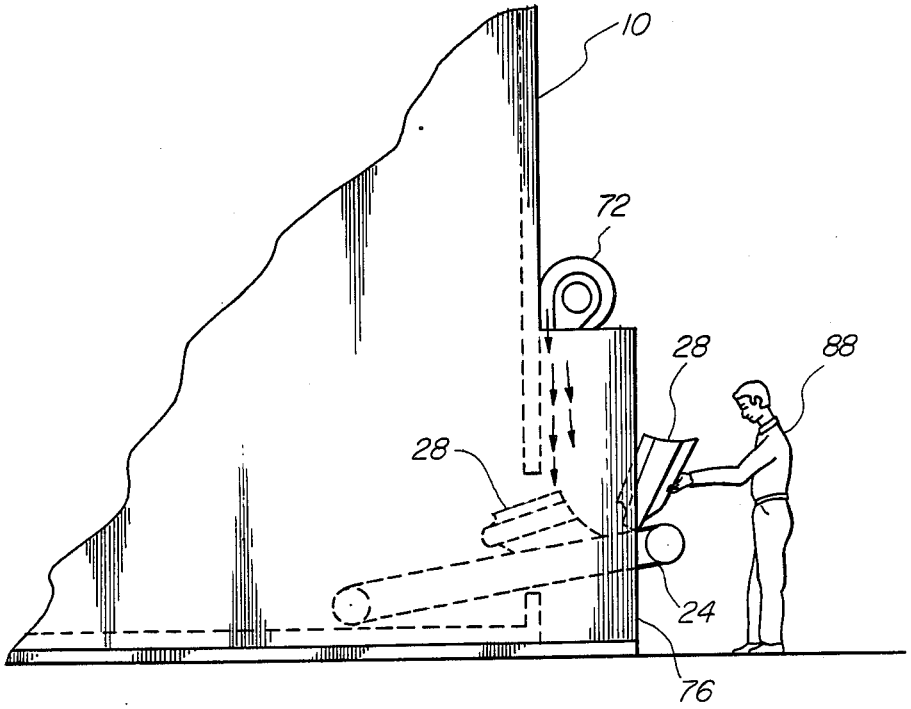
FIG. 6 is an enlarged side elevation view of the apparatus of FIG. 2, partially cut away, to illustrate the unloading station with a shield placed around the portion of the exit conveyor extending outside of the main housing.

Referring now to FIG. 5 an operator 86 is shown as loading the molded articles 26 onto the baskets 28 at the loading station 18. FIG. 6 illustrates an operator 88 unloading the deflashed articles at the unloading station 20.

Figure 7:
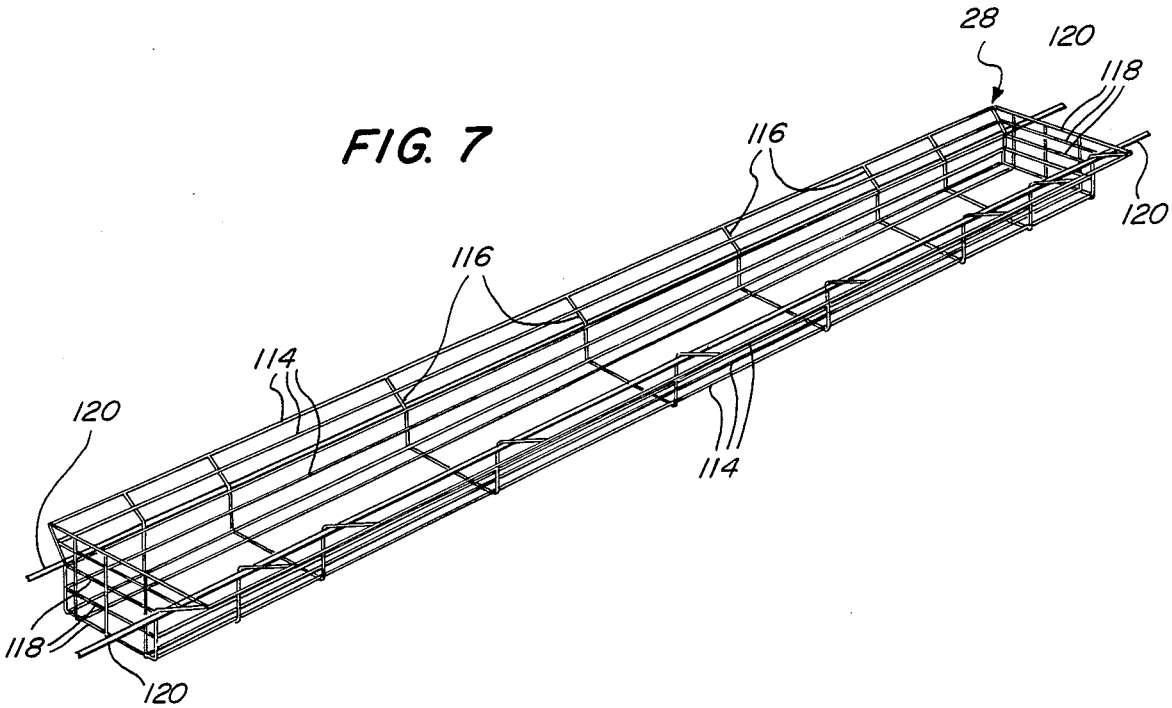
FIG. 7 is an enlarged perspective view of one of the article carrying baskets utilized in the apparatus of FIG. 1.

FIG. 7 illustrates one of the baskets 28 for holding the articles to be deflashed. Longitudinal rods or wires 114 are welded to lateral wires 116 and end wires 118 to form a wire mesh basket open at the top. The baskets include longitudinal guide bars 120 for connection to the drive mechanism (such as a chain, not shown in FIG. 1) for the conveyor 22. As discussed previously the baskets are individually designed for specific articles so that when the articles are placed in the baskets they will have a predetermined orientation. Thus when the baskets 28 are moved by the conveyor 22 into the deflashing chamber (See FIG. 1) the articles will have a predetermined attitude with respect to the vertical axis x—x around which the blast media pattern is centered. This arrangement optimizes the removal of flash by ensuring that the side of the article to which the flash is attached is positioned to be bombarded directly by the blasting media.

Figure 8:
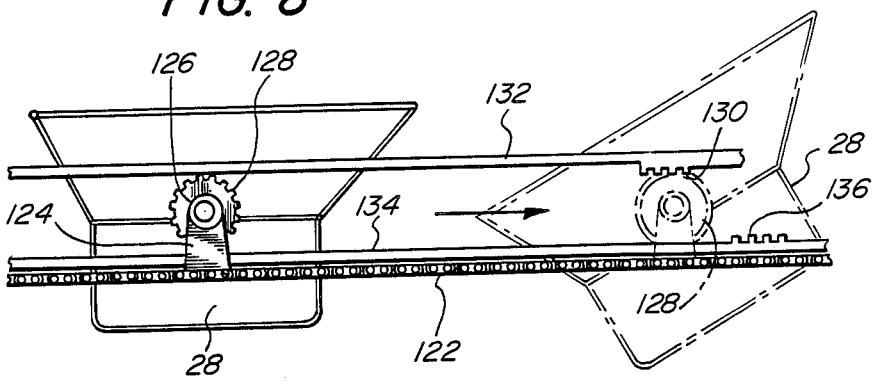
FIG. 8 is a side elevation view of an adjustment mechanism for changing the attitude of the conveyor baskets as they travel through the deflashing station or chamber.

FIG. 8 illustrates an arrangement for changing the orientation of the baskets 28 during their travel through the deflashing chamber 16. A chain drive 122 supports and moves the baskets 28 by means of an end bracket 124 (carried by the chain on each side of a basket) and a stub axel 126 extending from each end of a basket. The axels 126 are secured to the basket and rotatably mounted in the brackets 124. A gear 128 is mounted on one of the axels 126 and is arranged to mesh with gear teeth 130 on an upper gear bar 132 which is held in a stationary position above the chain drive 122. A lower stationary gear bar 134 positioned parallel to the upper bar 132 also includes teeth 136. The teeth 130 and 136 are arranged to pivot the basket in the forward and/or reverse direction as it moves past the deflashing station to expose any desired area of the molded articles to the blasting pattern.

Figure 9:
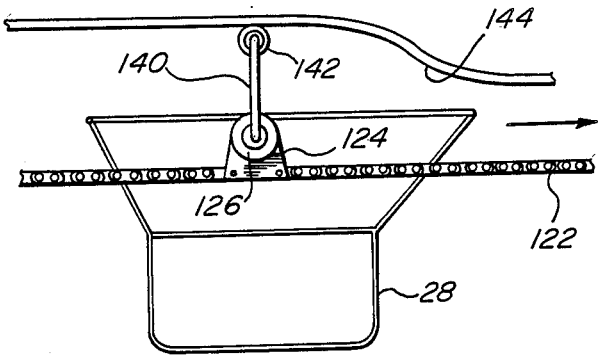
FIG. 9 is a side elevation view of an alternative adjustment mechanism for changing the attitude of the conveyor baskets as they travel through the deflashing station.

FIG. 9 illustrates an alternative mechanism for changing the orientation of the article carrying baskets 28 during their travel through the deflashing chamber 16. In this arrangement a lever 140 is secured to one of the axels 126 and carries a roller 142 which rides along a cam surface 144 (formed by a bar or the like) to cause the basket to rotate about the bracket 124 as the position of the cam surface changes relative to chain drive 122.

It should be noted that the baskets may be provided with an open mesh wire cover to allow the articles to be tumbled as the baskets 28 are rotated by the gearing or cam arrangements shown in FIGS. 8 and 9.

There has been described a novel deflashing apparatus in which the final embrittlement temperature is reached in two stages through the use of conventional mechanical or vapor compression refrigeration and cryogenic refrigeration. The use of two separate refrigeration stages greatly increases the overall efficiency. In addition the introduction of the cryogen into a closed coil within the housing eliminates the risk of exposing operating personnel to the cryogen gas. Further, since the gas is vaporized inside a closed coil, it is available for reuse, with unaltered purity, in other processes. In addition the use of open mesh baskets for holding the molded articles in predetermined attitude with respect to the blasting media pattern reduces the deflashing time and reduces the risk of damaging the main body of the articles. Various modifications of the disclosed apparatus will be readily apparent to those skilled in the art without departing from the spirit and scope of my invention as set forth in the claims.

What is claimed is:

1. A deflashing apparatus for removing residual flash from molded article which comprises:

(a) a housing defining a plurality of serially oriented, individual work stations including a prechill station, a chill station and a deflashing station arranged in that order;

(b) means for providing an atmosphere of air within the work stations;

(c) vapor compression refrigeration means connected to the prechill station for maintaining a temperature at the prechill station which is between the ambient temperature outside of the housing and the temperature required to embrittle the residual flash, the vapor compression refrigeration means including a heat exchanger disposed within the the housing adjacent the prechill station, means for continuously circulating refrigerant through the heat exchanger in a vapor compression cycle so that the refrigerant within the heat exchanger has a temperature below ambient and means for circulating air through the heat exchanger and over the articles located at the prechill station;

(d) cryogenic refrigeration means connected to the chill station, the cryogenic refrigeration means including a closed coil disposed within the housing, and means for introducing liquid cryogen at a temperature below that required to embrittle the flash into the coil, means for circulating air over said coil and against the molded articles located at the chill stations to embrittle the residual flash on the articles, and means for exhausting the vaporized cryogen from the coil outside of the housing for venting or further use;

(e) means for directing a deflashing media at high velocity at articles located at the deflashing station to remove the residual flash therefrom; and (f) conveyor means for transporting the articles to be deflashed through each of the prechill, chill and deflash stations.

2. The deflashing apparatus of claim 1 wherein the deflashing media directing means is positioned above the molded articles and arranged to propel the media downwardly against the molded articles and wherein the means for transporting the articles includes a plurality of open mesh baskets arranged to travel serially past the work stations, each basket being arranged to receive and orient the molded articles with respect to the direction at which the deflashing media is propelled to expose a preselected area of the articles to the deflashing media.

3. The deflashing apparatus of claim 1 wherein the cryogenic refrigeration means includes a vaporizer containing the coil disposed within the housing, the vaporizer having an inlet conduit connected to one end of the coil for receiving the cryogenic liquid and an outlet conduit connected to the other end of the coil and extending outside of the housing for discharging the cryogenic gas.

4. The deflashing apparatus of claim 1 wherein the prechill and chill stations are separated by a partition wall to inhibit the intermixing of air between the stations, the partition wall having an opening therethrough for accommodating the conveyor means.

5. The deflashing apparatus of claim 4 including load and unload stations through with the conveyor means passes, the load station being located outside of the housing adjacent the prechill station and the unload station being located outside of the housing adjacent the deflashing station.

6. The deflashing apparatus of claim 5 further including blower means individually disposed between the load and prechill stations and the unload and deflashing stations to inhibit the egress of cooled air from the housing.

7. The deflashing apparatus of claim 6 wherein the housing defines an entrance opening between the load and prechill station and an exit opening between the deflashing and unload station and wherein said blower means is arranged to provide a current of air past each of said openings.

8. The deflashing apparatus of claim 7 wherein the blower means includes a plurality of blowers arranged to blow air in a downward direction past each of said openings.

9. The deflashing apparatus of claim 8 wherein the vapor compression refrigeration means includes a second heat exchanger disposed within the housing adjacent the deflashing station, means for continuously circulating refrigerant through the second heat exchanger and means for circulating air through the second heat exchanger and against the articles located at the deflashing station to maintain the flash in an embrittled condition and to control the humidity.

10. The deflashing apparatus of claim 9 including means for separating the flash from the molded articles at the deflashing station.

11. In a continuous deflashing apparatus for removing residual flash from molded articles, the combination which comprises:

(a) a housing defining a plurality of serially aligned chambers including a prechill chamber, a chill chamber and a deflashing chamber arranged in that order;

(b) a heat exchanger;

(c) means for continuously circulating refrigerant through the heat exchanger in a vapor compression cycle;

(d) means for circulating air through the heat exchanger and over the articles located at the prechill chamber to lower the temperature of the articles;

(e) a vaporizer;

(f) means for supplying cryogenic liquid to the vaporizer;

(g) means for circulating air through the vaporizer and over the articles located in the chill chamber to embrittle the residual flash on the articles;

(h) means for exhausting the warmed cryogenic gas from the vaporizer and outside of the housing;

(i) means for directing a deflashing media at articles located in the deflashing chamber to remove the residual flash therefrom, the deflashing media directing means being positioned above the conveyor means and arranged to propel the media downwardly against the molded articles; and (j) conveyor means for transporting the articles to be deflashed through each of the chambers, the conveyor means including a plurality of open mesh baskets arranged to travel serially through the chambers, each basket being arranged to receive and orient the molded articles in the deflashing chamber with respect to the direction at which the deflashing media is propelled to expose only a preselected area of the articles to the deflashing media.

12. The deflashing apparatus of claim 10 wherein the prechill and chill chambers are separated by a partition wall to inhibit the intermixing of air between the chambers, the partition wall having an opening therethrough for accomodating the conveyor.

* * * * *